United States Patent [19]

Uchihashi et al.

[11] Patent Number: 4,866,682

[45] Date of Patent: Sep. 12, 1989

[54] TRANSDUCER DEVICE

[75] Inventors: Syozo Uchihashi; Isao Yamamoto, both of Kobe; Kenji Takeno, Nishinomiya, all of Japan

[73] Assignee: Furuno Electric Company, Nishinomiya, Japan

[21] Appl. No.: 620,402

[22] Filed: Jun. 14, 1984

[30] Foreign Application Priority Data

Jun. 24, 1983 [JP] Japan ..... 58-114971

[51] Int. Cl.[4] ..... H04R 17/00

[52] U.S. Cl. ..... 367/153; 367/173; 367/155; 367/168; 310/337

[58] Field of Search ..... 367/153, 154, 155, 156, 367/157, 158, 159, 162, 167, 168, 172, 173, 176; 310/26, 337, 326

[56] References Cited

U.S. PATENT DOCUMENTS

| | | | |
|---|---|---|---|
| 2,473,971 | 6/1949 | Ross | 367/155 X |
| 2,515,154 | 7/1950 | Lanphier | 367/156 |
| 3,922,572 | 11/1975 | Cook et al. | 367/157 X |
| 3,992,693 | 11/1976 | Martin et al. | 367/155 |
| 4,271,490 | 6/1981 | Minohara et al. | 367/154 X |

*Primary Examiner*—Deborah L. Kyle
*Assistant Examiner*—J. Woodrow Eldred
*Attorney, Agent, or Firm*—Jordan and Hamburg

[57] ABSTRACT

The present invention is directed to an ultrasonic device comprising a plurality of transducer elements arranged in rows and columns and acoustic insulation material maintained between each two adjacent rows of transducer elements. The ultrasonic device comprises (i) a plurality of rows of the transducer elements, each row being disposed on an imaginary circle, (ii) a plurality of circular plates each supporting one of said rows and (iii) spacers for spacing adjacent plates of the plurality of plates at a predetermined space interval, thereby forming a cylindrical array.

9 Claims, 6 Drawing Sheets

FIG. 6
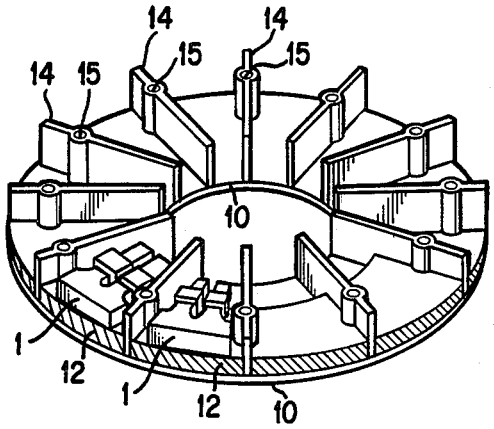
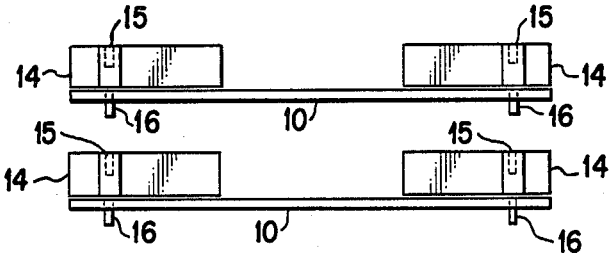
FIG. 7

TRANSDUCER DEVICE

BACKGROUND OF THE INVENTION

The present invention relates to an ultrasonic transducer device comprising a plurality of transducer elements arranged in rows and columns and acoustic insulation material maintained between adjacent transducer elements, for converting electrical energy into ultrasonic wave energy to be radiated into the water and vice versa. Particularly, the invention relates to the improved structure of the transducer device.

The transducer elements may be disposed on a plane in rows and columns at uniform or different space intervals in one of mutually perpendicular directions or in both directions thereof, thereby forming a planar array of the transducer elements. The transducer elements may be disposed in rows and columns along the circumference of a cylinder at uniform or different space intervals, thereby forming a cylindrical array. As the transducer elements, magnetostrictive or electrostrictive ultrasonic transducers may be used.

An ultrasonic tranducer device of this type has been proposed by the applicant and disclosed in a laid-open Japanese Patent Application No. 25080 of 1981. Referring to FIGS. 1, 2 and 3, the conventional transducer device will be explained. Numerals 1, 1 . . . are magnetostrictive transducer elements of the II-type. Thirty of the transducer elements are disposed on an imaginary circle at angular uniform intervals, thereby forming a circular row of the transducer elements. There are ten such rows from the top of the bottom of the transducer assembly. The transducer elements of each row are acoustically insulated from the ones of rows adjacent thereto by transducer liners 2, 2 . . . and 3, 3 . . . made of acoustic insulation material such as cork or urethane foam. The outer transducer liner 2 and the inner transducer liner 3, each shaped in a ring form, are disposed concentrically on an imaginary plane, as illustrated in FIG. 3. The II-type magnetostrictive transducer elements 1, 1 . . . are circularly mounted on the transducer liners 2 and 3 at uniform angular intervals in radially extending relation. The transducer elements are disposed on the transducer liners 2 and 3 in a manner that the sound sensing part of each one of the transducer elements 1 is supported by the outer transducer liner 2 and the leg parts thereof are supported by the inner transducer liner 3, as shown in FIG. 2. The sound sensing part 1A of each one of the transducer elements is stuck to the outer transducer liner 2, and the leg parts thereof are supported by the inner transducer liner 3 with their surfaces merely kept in contact with the surface of the transducer liner 3 so that their vibration energy can be activated by coils 1C in a form of electric signal. Each of permanent magnets 4 is maintained between the legs of respective one of the transducer elements 1 to provide a biasing magnetic field, and is fixed to the inner transducer liner 3. The front surfaces of the transducer elements arranged in thirty straight columns and ten circular rows with the transducer liners 2, 3 being inserted between the adjacent rows of the transducer elements, are covered by sound passing material Rho-C rubber such as urethane rubber, which is molded. Ultrasonic waves are transmitted and received into and from the water through the molded cover 5. Thus, the outer transducer liners 2 are supported by the cylindrically shaped molded cover 5. Each one of the transducer elements 1 is stuck to the outer transducer liners 2. The inner transducer liners 3 support the leg parts 1B of the transducer elements 1. Each one of the permanent magnets 4 maintained between the leg parts the each transducer element 1 is stuck to the inner transducer liner 3. Hence, the inner transducer liners 3 are concentrically disposed with respect to the outer transducer liners 2. The transducer elements in rows and columns and the transducer liners maintained between adjacent rows of the transducer elements are arranged in a cylindrical form. The cylindrical transducer assembly is closed by an upper end head 6 and a lower end head 7 water-tightly by means of support shafts 8 and cap screws 8.

Thus, the conventional transducer device has been constructed in a manner that the transducer elements arranged in ten circular rows and the transducer liners 2, 3 maintained on and beneath each row of the transducer elements are pressed by the upper and lower end heads 6, 7 to be held. The transducer liners 2, 3 must be made of hard material so that the transducer liners are not deformed due to the pressure imposed by the end heads 6, 7. Cork or urethane foam have been employed as the hard material. These materials perform the acoustic shielding between the transducer elements of the two adjacent rows, since air is contained in small holes extensively formed therein. When pressing forces are applied to the material, the small holes shrink by small amounts, thereby reducing the whole material in size by a small amount. In order to cope with this problem, the transducser liners 2 and 3 have been manufactured a little larger than desired. A desired thickness of each one of the transducer liners has been obtained by the pressing force applied thereto when the transducer device is assembled as illustrated in FIG. 1, thereby shrinking the transducer liners.

However, it is impossible to manufacture the transducer liners 2, 3 in such a way that the height of each one of the transducer liners is exactly the same as that of the others. The thickness of the transducer liners manufactured varies from one to another. Further, the shrinking degree of the liners differs depending on the number and size of the small holes therein containing air even if the same pressing force is applied thereto. Accordingly, when the transducer liners 2, 3 and the transducer elements 1 stacked are pressed from the upper and lower directions to be held, the shrinking degree of the transducer liners 2, 3 differs from one to another, so that the space intervals between the vertically adjacent transducer elements differ from one to another by small amounts. Such unequal space intervals between the vertically adjacent transducer elements considerably affect the performance of the transducer device. With the transducer device, the ultrasonic waves radiated from a plurality of the transducer elements or the echo signals caught thereby are combined together in phase. It is important to dispose the transducer elements at a predetermined interval between the adjacent rows of the transducer elements. If the intervals between the vertically adjacent transducer elements are different from the predetermined one, a directional pattern can not be formed in a specific direction by combining in phase the ultrasonic waves transmitted from the transducer elements or the echo signals caught thereby, or transmission or reception sensitivities, i.e., side lobes in undesired directions, increase, thus considerably deteriorating the performance of the transducer device.

Further, the pressing forces produced by the upper and lower end heads 6,7 directly act on the transducer elements 1, so that an increase of the pressing forces applies a load to the vibrational operation of the transducer elements 1. Therefore, the pressing forces produced by the heads 6, 7 must be set so that the vibrational operation of the transducer elements 1 is not affected.

The transducer assembly shown in FIG. 1 is extremely weak against a force acting on the molded cover 5 from the outside thereof. In other words, the transducer elements 1 and the stacked transducer liners 2, 3 are likely to be deformed or displaced, when forces from the outside act thereon through the molded cover 5. Accordingly, the whole transducer device shown in FIG. 1 must be housed in a dome, thus making the side of the whole device larger. The transmission loss of the ultrasonic waves becomes greater, since they are transmitted or received through the dome.

Accordingly, an object of the invention is to provide a transducer device comprising a plurality of transducer elements arranged in rows and columns, which can be easily assembled.

Another object of this invention is to provide a transducer device in which a plurality of transducer elements are precisely disposed at predetermined space intervals, so that a directional radiation or reception pattern is formed in a specific direction and the amplitude of side lobes is reduced.

One more object of this invention is to provide a transducer device which is strong enough to stand external forces acting thereon and hence can be directly exposed to the water.

SUMMARY OF THE INVENTION

In order to achieve these and other objects of the invention, in accordance with one aspect of the present invention, a transducer device is provided which includes (i) a plurality of rows of transducer elements, with said each row comprising a plurality of transducer elements disposed on an imaginary line, (ii) a plurality of plates, with said each plate supporting one of said rows of the transducer elements, (iii) spacers for spacing the adjacent plates at predetermined space intervals, (iv) acoustic insulation maintained between the adjacent rows of the transducer elements, (v) sound passing material covering the front surfaces of the transducer elements, and (vi) enclosing means for water-tightly enclosing said transducer elements supported by said plurality of plates except the front surface of the device formed by said sound passing material.

Other objects and features of the present invention will be described in more detail herein with reference to the accompanying drawings.

BRIEF DESCRIPTION OF THE DRAWINGS

FIG. 6 is a perspective view of a part of a transducer device in accordance with another embodiment of the present invention; and FIG. 7 is a partly sectional side view of two of the transducer device parts shown in FIG. 6.

Throughout the drawings, the same reference numerals are given to like components.

DESCRIPTION OF THE PREFERRED EMBODIMENTS

Figure 1:
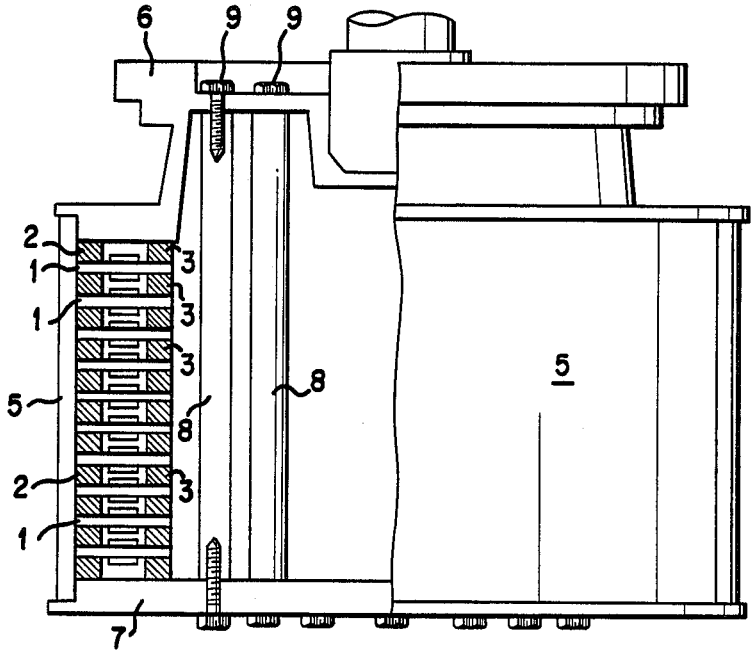
FIG. 1 PRIOR ART
FIG. 1 is an elevation view of a conventional transducer device partly and longitudinally sectioned.
Figure 2:
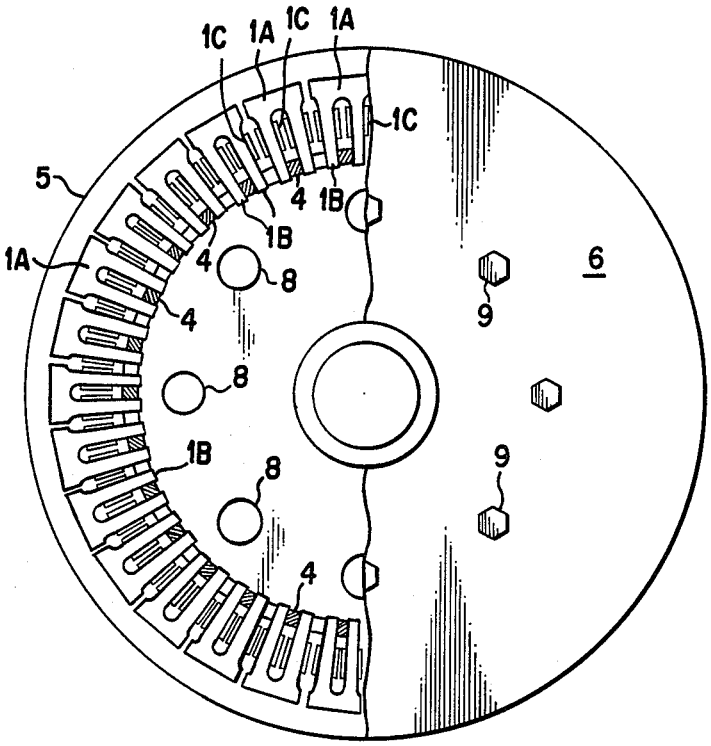
FIG. 2 PRIOR ART
FIG. 2 is a plan view of the conventional transducer device partly sectioned.
Figure 3:
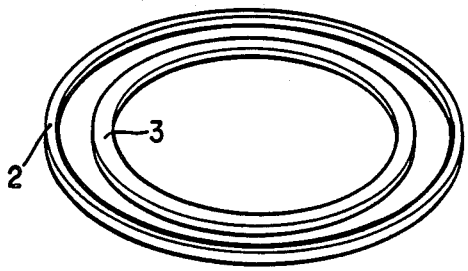
FIG. 3 PRIOR ART
FIG. 3 is a perspective view of the transducer liners used in the conventional transducer device.
Figure 4:
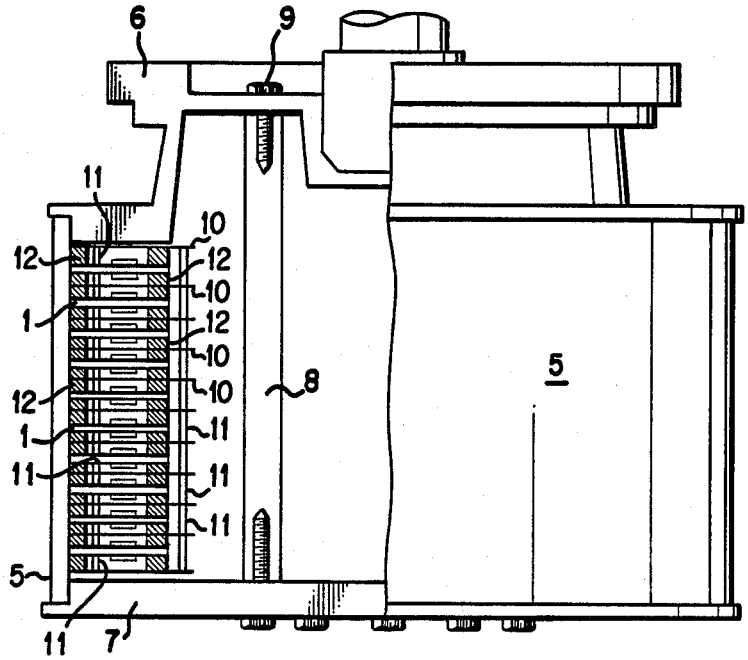
FIG. 4 is an elevation view of a transducer device in accordance with an embodiment of the present invention, partly and longitudinally sectioned.

Referring to FIG. 4, circular plates 10 are made of non-magnetic material such as aluminum or copper. Spacers or spacing rods 11 made of hard non-magnetic material are shaped in a columnar form and have screw holes at their both ends. The spacing rods 11 are fixed at their both ends to the two adjacent circular plates with screw bolts, thereby forming ten stores, in each of which the transducer elements 1 are housed. The height of each of the stories, i.e., the space interval between the adjacent circular plates 10, is determined by the length of the spacing rods 11. Transducer liners 12 are, for example, made of soft acoustic insulation material such as sponge, and shaped in a ring form. The outer and inner transducer liners 12 are stuck to both sides of the circular plate 10. The transducer elements 1 are maintained between the transducer liners 12 fixed to the lower side of an upper circular plate 10 and the ones fixed to the upper side of a lower circular plate 10.

Figure 5:
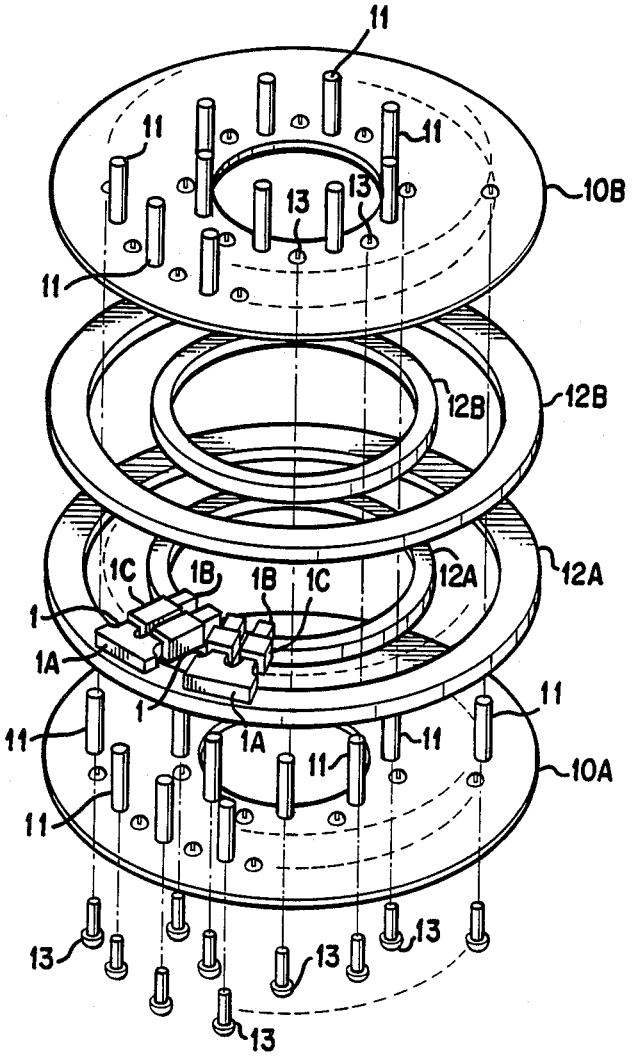
FIG. 5 is an explanatory diagram for explaining the main part of the transducer device shown in FIG. 4.

Referring to FIG. 5, lower outer and inner transducer liners 12A are concentrically disposed and fixed to a lower circular plate 10A, while upper outer and inner transducer liners 12B are concentrically disposed and fixed to the lower side of an upper circular plate 10B. The transducer elements 1 are fixedly arranged on the transducer liners 12A at uniform angular intervals in radially extending relation. The sound sensing part 1A of each one of the transducer elements 1 and the leg parts 1B thereof are stuck to the outer and inner transducer liners 12A respectively. The height of the transducer liners 12A, 12B is determined in such a way that the exciting coils 1C do not touch the circular plates 10A, and 10B, when the transducer elements 1 are mounted on the transducer liners.

The circular plates 10A, 10B fixedly hold the transducer elements 1 through the transducer liners 12A, 12B, and are fixedly connected with each other by means of the spacing rods 11 and screw bolts 13. Thus, the space interval between the circular plates 10A and 10B is determined by the length of the spacing rod 11. The length of the spacing rod 11 is so selected that the space interval between the two vertical adjacent transducer elements is as desired, when the circular plates 10 are stacked and the transducer elements are housed in each resultant story as illustrated in FIG. 4.

After eleven circular plates 10 are connected with the spacing rods 11 at uniform space intervals therebetween, they are pressed between and thereby held by the upper and lower heads 6, 7. The transmission and reception surfaces of the transducer elements 1 are covered by sound passing material such as urethane rubber.

As apparent from the foregoing, the transducer elements of each row disposed on an imaginary circle are fixedly supported by the corresponding circular plate 10. The space interval between the adjacent circular plates is determined by the length of the spacing rods 11. Therefore, even when the stacked body obtained by connecting the eleven circular plates 10 with the spacers 11 is pressed by the upper and lower end covers 6, 7, the resultant pressing forces do not act on the transducer elements directly.

The arranged transducer elements 1 are not affected by outer forces acting on the front surface of the molded cover 5, since the circular plates 10 connected with the connecting rods 11 are of sufficient mechanical strength to stand the forces. Hence, the transducer device can be directly exposed to the water and is driven to radiate and receive ultrasonic waves directly, without housing the device in a dome as in conventional devices. This results in the decrease of the sound transmission loss of the ultrasonic wave energy.

The distance between the adjacent rows of the transducer elements which are disposed on a horizontal imaginary circle is determined by the length of the spacing rods 11, and hence is not changed due to the pressing forces imposed. Accordingly, the present invention is capable of providing a transducer device having a good directional radiation or reception characteristic, since the distance between the vertically adjacent transducer elements can be easily set as desired.

The transducer liners 12 can be made of soft material such as sponge, as opposed to conventional transducer liners which are made of hard material such as cork or urethane foam, since the transducer liner 12 merely supports the transducer elements of one row. Sponge contains more small holes containing air than cork or urethane foam. Thus, sufficient acoustical shielding is attained.

Further, the circular plate 10 made of nonmagnetic material such as copper or aluminum provides electrostatic and magnetic shields between the vertical adjacent transducers, thereby preventing electric interference from occurring therebetween.

Referring to FIGS. 6 and 7, spacers 14 are shaped in a rectangular form and are disposed on the circular plate 10 at uniform angular intervals and fixed thereto in radially extending relation. The spacers 14 have vertical reception holes 15, while the circular plate 10 has pins 16 at positions corresponding to the reception holes 15. The pins 16 of each one of the circular plates 10 are inserted into the reception holes 15 of the spacers standing on one of the other circular plates 10, thus forming ten stories for housing the transducer elements. The transducer liners appropriately cut are placed in partitioned sections as shown in FIG. 6. An integrated circular plate 10, rectangular spacers 14 having holes 15 and pins 16 can also be manufactured.

Although the circular plate 10 is made of nonmagnetic material such as aluminum or copper in the foregoing embodiments of the invention, it should be noted that the circular plate 10 may also be made of hard resin material such as plastics. It is also possible to coat the surface of the resin material with a thin layer of copper or aluminum by metal plating, thereby providing the electrostatic and magnetic shields between the transducer elements as in the foregoing.

Although the transducer liners are fixed to both the upper and lower sides of the circular plate 10, and the transducer elements are sandwiched by the transducer liners as illustrated in FIG. 5, it should be noted that only the lower transducer liners 12A may be fixed to the circular plate 10A and the transducer elements be mounted theron.

Although a plurality of the circular plates are used in the foregoing embodiments of the invention, it should be noted that a plurality of rectangular plates can be also used with a plurality of the transducer elements arranged on each plate in an imaginary straight line. As a result, a planar array of the transducer elements is obtained. It should be also noted that a plurality of fan-like plates can be also used with a plurality of the transducer elements disposed on each plate in an imaginary arc. A semicylindrical array of the transducer elements is obtained.

While the invention has been described in detail and with reference to specific embodiments thereof, it will be apparent to one skilled in the art that various changes and modifications can be made thereto without departing from the spirit and scope of the invention.

What is claimed is:

1. A transducer device comprising:

(i) a plurality of rows of transducer elements, with each said row comprising a plurality of the transducer elements disposed on an imaginary line, (ii) a plurality of non-magnetic plates, with said each plate supporting one of said rows of the transducer elements so that the transducer elements are also arranged in columns, (iii) rigid spacers extending all the way between each adjacent pair of the plates for spacing the adjacent plates at predetermined space intervals, (iv) acoustic insulation material maintained between each adjacent pair of rows of the transducer elements, (v) a cover of sound passing material covering the front surfaces of said transducer elements arranged in rows and columns for conducting ultrasonic waves between said transducer elements and water in which the transducer device is immersed when used, and (vi) enclosing means cooperating with the cover for watertightly enclosing said arranged transducer elements supported by said plurality of the plates.

2. A transducer device as defined in claim 1 wherein each said transducer element comprises a magnetostrictive ultrasonic transducer.

3. A transducer device as defined in claim 1 wherein each said transducer element comprises an electrostrictive ultrasonic transducer.

4. A transducer device as defined in claim 1 wherein each said plate is made of non-magnetic material.

5. A transducer device as defined in claim 1 wherein said acoustic insulation material is sponge.

6. A transducer device as defined in claim 1 wherein said sound passing material is urethane rubber.

7. A transducer device as defined in claim 1 wherein said spacers are all of the same length.

8. A transducer device according to claim 1, in which the imaginary line is a circle, the disposition of the transducer elements on the imaginary circle being at uniform angular space intervals in radially extending relation, and the plates are circular.

9. A transducer device as defined in claim 8 wherein said spacers are all of the same length.

* * * * *